US005353599A

United States Patent [19]

Johnson et al.

[11] Patent Number: 5,353,599

[45] Date of Patent: Oct. 11, 1994

[54] FUEL NOZZLE SWIRLER FOR COMBUSTORS

[75] Inventors: Thomas G. Johnson, Palm Beach Gardens, Fla.; Cheng-Chang Ling, Tainan, Taiwan

[73] Assignee: United Technologies Corporation, Hartford, Conn.

[21] Appl. No.: 55,151

[22] Filed: Apr. 29, 1993

[51] Int. Cl.[5] ..... F23R 3/04

[52] U.S. Cl. ..... 60/748; 60/39.83

[58] Field of Search ..... 60/748, 756, 39.83, 60/740; 239/404, 405, 406, 132.3

[56] References Cited

U.S. PATENT DOCUMENTS

| | | | |
|---|---|---|---|
| 3,570,242 | 3/1971 | Leonardi et al. | 239/404 |
| 3,853,273 | 12/1974 | Bahr et al. | 60/748 |
| 3,901,446 | 8/1975 | Petreikis, Jr. et al. | 60/748 |
| 4,180,974 | 1/1980 | Stenger et al. | 60/748 |
| 4,842,197 | 6/1989 | Simon et al. | 239/406 |

*Primary Examiner*—Richard A. Bertsch
*Assistant Examiner*—Timothy S. Thorpe
*Attorney, Agent, or Firm*—Norman Friedland

[57] ABSTRACT

The swirler for the fuel nozzle of the combustor of a gas turbine engine in engine designs where the swirler is off set from the center line of the combustor, localized erosion is obviated by locating and angling air cooling holes around the air swirler body to for flowing the cooling air uniformly along the body surface from bottom up to the tip of the swirler.

5 Claims, 2 Drawing Sheets

FUEL NOZZLE SWIRLER FOR COMBUSTORS

This invention was made under a U.S. Government contract and the Government has rights herein.

TECHNICAL FIELD

This invention relates to swirlers used in the fuel nozzle for a combustor of a gas turbine engine and particularly to means for preventing erosion of the swirler due to localize heating.

BACKGROUND ART

As is known in the gas turbine engine field of technology, air swirlers utilized on fuel nozzles in the combustor of a gas turbine engine is disposed in a hostile environment and is subjected to extremely high temperatures. Historically, air swirlers have had an erosion problem which has required sophisticated cooling techniques to resolve this problem. Since the advent of higher performance engines that require higher temperatures at the inlet of the turbine, the combustor is relegated to operate at higher temperatures. The increased temperature in the combustor has acerbated the erosion problem. Additionally, certain engine designs require that the swirler be offset from the center line of the combustor. This, orientation of the swirler poses unusual and difficult cooling problems which even under ordinary circumstances is an already difficult problem. Experience has shown that a 0.100 inch offset from the combustor's center line has evidenced erosion problems that would invariably prematurely erode one half of the swirler. The offset locates one side of the swirler closer to the cooler air and the other side is, obviously, further away, such that the localized heating on the side that is adjacent the hotter air causes severe erosion.

U.S. Pat. No. 4,584,834 granted to J.M. Koshoffer et al on Apr. 29, 1986 discloses a fuel nozzle/swirler combination which attempts to prevent heat streaks from occurring on the liner of the combustor. In this disclosure the fuel nozzle/swirler design includes means for controlling the discharge spray angle of the fuel air mixture in order to obviate the hot streaking problem. This invention is significantly different from the teachings of the 4,584,834 patent,supra, as it is not concerned with the mixture of the fuel/air, nor is it concerned with hot streaks directed toward the combustor's liner. This invention solves the problem incidental to the offsetting of the fuel nozzle from the combustor's center line to obviate erosion occasioned by the uneven cooling of the air swirlers.

We have found that by judiciously locating and orienting the admission cooling air hole to the swirler will distribute the cooling uniformly around the swirler and obviate the erosion problem alluded to in the above paragraph.

SUMMARY OF THE INVENTION

An object of this invention is to provide an improved swirler for the fuel nozzle used on the combustors of gas turbine engines.

A feature of this invention is to provide in a swirler as described sufficient angled holes distributed around the body of the swirler to attain uniform cooling independently of the position of the fuel nozzle.

A feature of this invention is to provide a swirler as described that attains uniform cooling and is characterized as being simple and inexpensive to incorporate into the swirler body.

The foregoing and other features of the present invention will become more apparent from the following description and accompanying drawings.

BEST MODE FOR CARRYING OUT THE INVENTION

Figure 1:
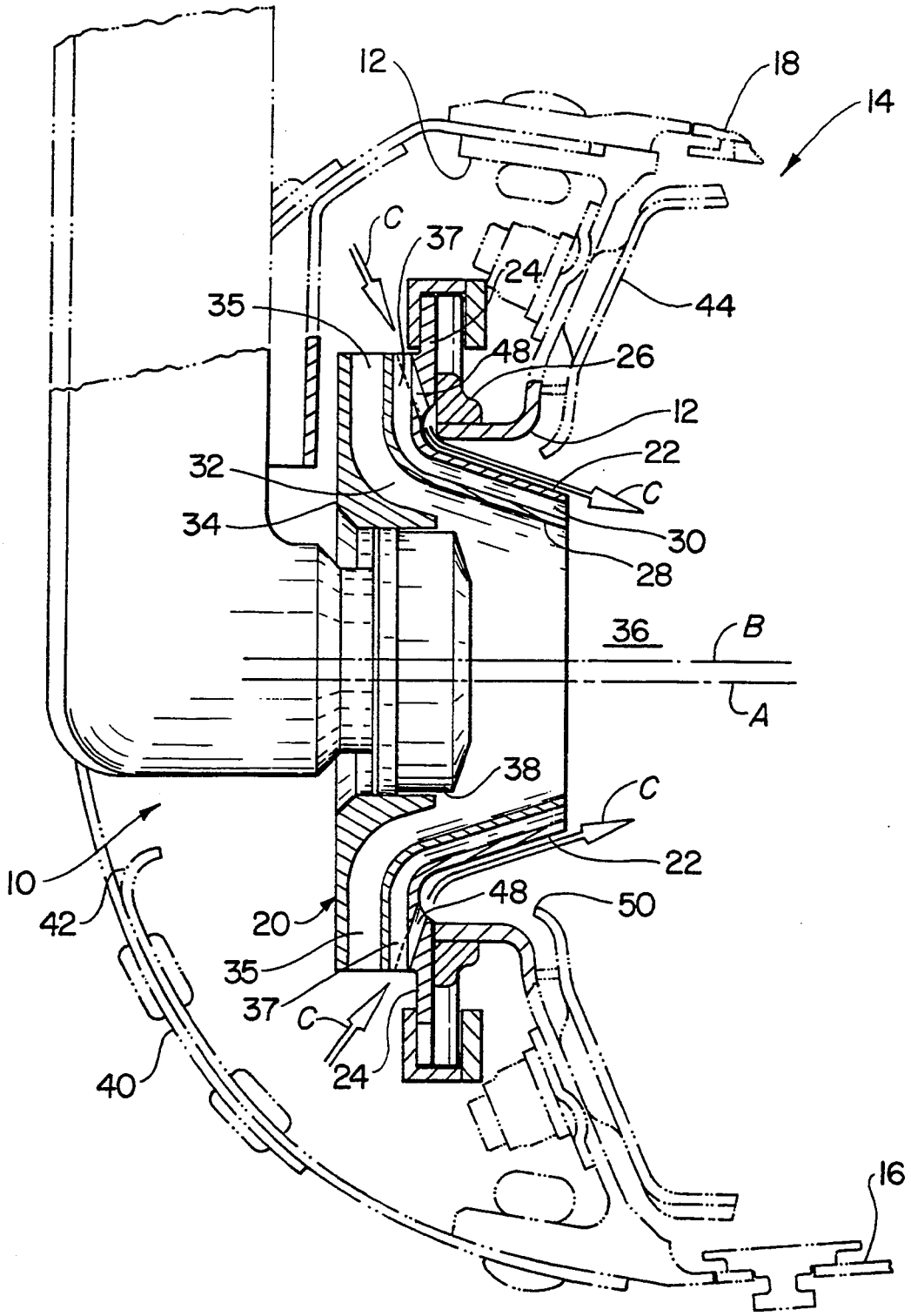
FIG. 1 is a partial view, partly in section and partly in elevation, illustrating the details of this invention as utilized in the combustor of a gas turbine engine.

Essentially FIG. 1 shows the dome of the combustor of a gas turbine engine including a fuel nozzle and its air swirler attached to the dome. Since this invention is primarily concerned with the air swirler, all the other components of the combustor and gas turbine engine are omitted herefrom for the sake of simplicity and convenience. For additional details of the combustor reference should be made to U.S. Pat. No. 4,655,044 granted to J. A. Dierberger and T. F. Tumicki on Apr. 7, 1987 and U.S. Pat. No. 4,548,032 granted to D. Sepulveda and E. E. Striebel on Oct. 22, 1985, both of which are assigned to United Technologies Corporation, the assignee of this patent application.

Figure 2:
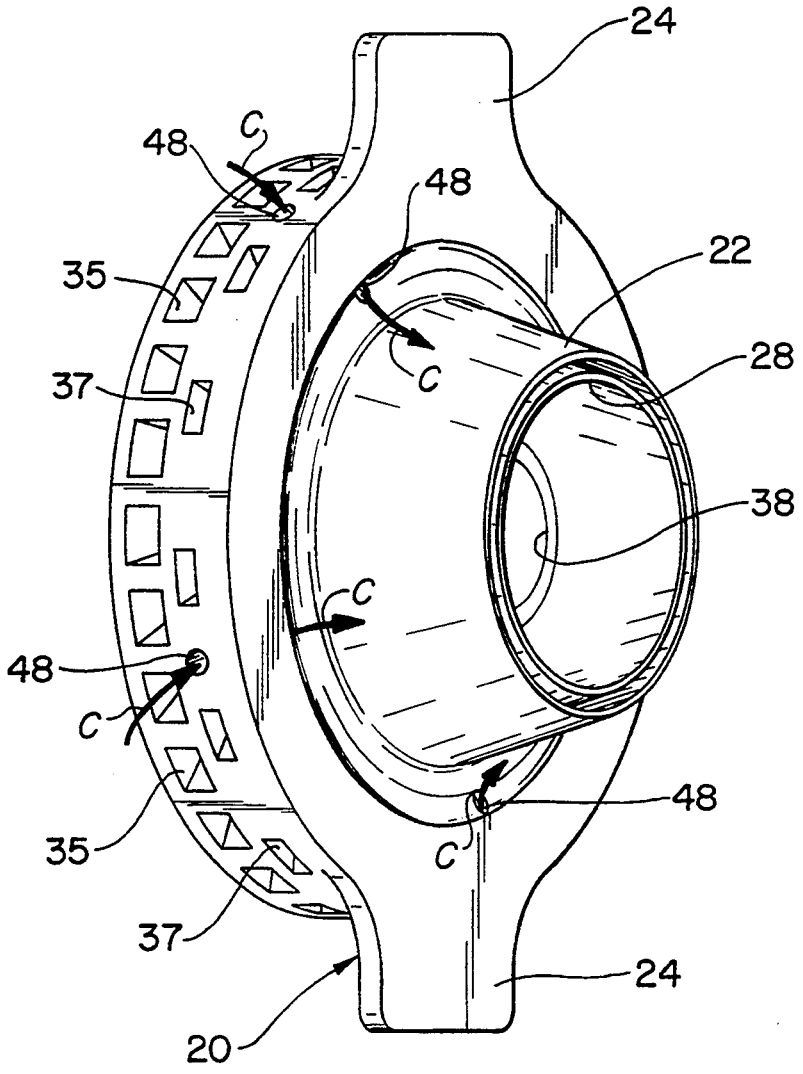
FIG. 2 is a perspective view of the air swirler of this invention.

As can be seen in FIGS. 1 and 2 the fuel nozzle generally indicated by reference numeral 10 is mounted in a hole formed in the dome 12 of the annular combustor generally indicated by reference numeral 14. The dome 12 is mounted on the front ends of inner liner 16 and outer liner 18, both of which are concentrically mounted around the center line of the engine and together define an annular combustion passage extending axially along the engine. Dome 12 carries a plurality of circumferentially spaced fuel nozzles 10 identical to the one depicted in FIG. 1 for delivering fuel to the combustor. The center line A taken along the longitudinal axis of the combustor as seen through the transverse plane of the combustor and the center line B of the fuel nozzle 10 are offset from each other, as shown in FIG. 1. Heretofore known designs typically align both center lines in coincidence. Conventionally, cooling air from the compressor of the engine (not shown) enters into the dome cavity ahead of the fuel nozzles from the fixed position in the dome or slots between the dome and the air swirler. Because of the offset the heretofore known cooling techniques have proven to lack the capacity to effectively to cool the entire outside surface of the swirler uniformly. The offset of the fuel nozzle, in effect, incurs an uncertainty to the fuel nozzle position relative to the fixed cooling holes such that one side is closer to the cooling air and the other side is further away from the cooling air. Consequently, the side adjacent the hotter air results in complete and premature localized erosion.

The air swirler generally indicated by reference numeral 20 comprises a generally frusto-conically shaped outer body 22 carrying radially extending flange 24 suitably attached to the flange 26 bonded to the dome 12. Air swirler 20 includes an inner frusto-conical inner body 28 concentrically spaced from the outer body 22 to define an air passage 30. An inner passage 32 defined by the frusto-conical wall 34 and the inner wall 28 serves to admit compressor air to mix with the fuel being discharged into the combustor's front end or combustion zone 36 by the fuel nozzle 10. A central aperture 38 formed in the wall 34 is adapted to accommodate the fuel nozzle and seal it from the hot combustion gases. Suitable turning vanes 35 and 37 are disposed at the inlet end of passages 32 and 30, respectively to impart a rotation to the air being admitted thereto from the front end of dome 12.

A combustor cowling 40 encompasses the front end of the combustor and includes aperture 42 to admit compressor air into the combustor. The combustor includes a fire wall or heat shield 46 to shield the front end of the dome from the heat generated by the combustion process at the front end of the combustor. Heat shield 46 is suitably bolted to the dome.

It is apparent from the foregoing that a portion of the air swirler 20 sees cooling air at the forward end thereof and hot combustion gases at the aft end thereof. As noted above, because of the offset of the air swirler from the combustor's centerline A, the air swirler without this invention would not be uniformly cooled and as has been witnessed in actual tests have proven to incur prematurely eroded surfaces on the outer surface of the swirler.

In accordance with this invention a plurality of angled holes relative to the longitudinal axis of the swirler are circumferentially disposed around the inlet of passage 30 for admitting cooling air to flow along the outer surface of the outer wall 22. As noted the cooling air is uniformly spread along the surface from the bottom up to the tip of the swirler. The angle is selected to direct the flow indicated by the arrows C to generally conform to the conical shape of the outer wall 22.

The air being carried by the air swirler is independent of the position of the fuel nozzle which is offsetting the swirler with the combustor. Hence, this cooling action achieves the uniform cooling effect without being affected by the position of the fuel nozzle. As an additional consequence of this invention and a benefit to the overall engine design, the cooling air for the outer surface of the air swirler flows adjacent the inner edge 50 of the heat shield 44 and contributes to cooling this member, which obviously is in the hottest location of the engine.

Although this invention has been shown and described with respect to detailed embodiments thereof, it will be appreciated and understood by those skilled in the art that various changes in form and detail thereof may be made without departing from the spirit and scope of the claimed invention.

We claim:

1. For a combustor mounted about the longitudinal axis of a gas turbine engine including a dome at the forward end of the combustor and a plurality of fuel nozzles mounted in each of a plurality of apertures formed in the forward end of said dome and a plurality of bodies defining frusto-conically shaped air swirlers concentrically mounted relative to and supported to each of said fuel nozzles and the alignment of the fuel nozzles relative to said apertures causing said air swirlers to be offset relative to the longitudinal axis of the combustor, said bodies having an outer surface having a portion thereof exposed to the gasses of said combustor, means for uniformly cooling said bodies of said air swirlers independent of the position of the fuel nozzle including a plurality of drilled air cooling holes formed on the outer periphery of each of the bodies of said frusto-conically shaped air swirlers having an inlet disposed upstream of said dome and an outlet adjacent the surface of each of the bodies of the air swirler on the downstream end of the dome for leading cooling air along the surface of the portion of each of said bodies exposed to said combustion gasses, and said drilled holes being acutely angled relative to said longitudinal axis.

2. For a combustor as claimed in claim 1 wherein said air cooling holes are equally spaced around the circumference of said frusto-conically shaped air swirlers.

3. For a combustor as claimed in claim 2 wherein said air swirler includes an outer frusto-conically shaped wall, an inner frusto-conically shaped wall concentrically mounted relative to said outer wall and defining an annular passage there between, a front wall having an inner surface concentric to and extending a short axial distance relative to said inner wall and defining therewith short inner annular passage, and means at the inlet end of said annular passage and said inner annular passage for imparting a swirl motion to said cooling air.

4. For a combustor as claimed in claim 3 including means for shielding the heat from said combustor including a plate like member spaced from said dome and attached thereto having an end portion extending adjacent the outlet end of said air swirler, whereby the cooling air discharging from said outlet cools said end portion.

5. For a combustor as claimed in claim 3 including flange means extending radially from said body of said air swirlers and means for attaching said flange means to said dome.

* * * * *